United States Patent [19]

Annis, Jr. et al.

[11] 4,096,051

[45] Jun. 20, 1978

[54] TUBULAR ANODE FOR CATHODIC PROTECTION

[75] Inventors: Russell K. Annis, Jr.; John W. McKinney, Jr.; Robert C. Schenck, Jr.; Delvin P. Sims, all of Dayton, Ohio

[73] Assignee: The Duriron Company, Inc., Dayton, Ohio

[21] Appl. No.: 461,971

[22] Filed: Apr. 18, 1974

[51] Int. Cl.[2] ..... C23F 13/00

[52] U.S. Cl. ..... 204/196; 204/280

[58] Field of Search ..... 204/147, 148, 196, 197, 204/280

[56] References Cited

U.S. PATENT DOCUMENTS

| | | | |
|---|---|---|---|
| 1,608,709 | 11/1926 | Mills | 204/197 |
| 3,043,765 | 7/1962 | Bryan et al. | 204/196 |
| 3,098,027 | 7/1963 | Flower | 204/196 |
| 3,317,415 | 5/1967 | Delahunt | 204/196 |
| 3,326,791 | 6/1967 | Heuze | 204/196 |

FOREIGN PATENT DOCUMENTS

| | | | |
|---|---|---|---|
| 1,153,172 | 5/1969 | United Kingdom | 204/196 |

*Primary Examiner*—T. Tung

*Attorney, Agent, or Firm*—Biebel, French & Nauman

[57] ABSTRACT

Sacrificial tubular anode structures having a generally centrally located connection. This design gives a uniform metal consumption pattern, thus protecting the electrical connection from premature failure, preventing anode separation due to concentrated metal consumption, and reducing the tendency for gas blocking.

8 Claims, 2 Drawing Figures

TUBULAR ANODE FOR CATHODIC PROTECTION

BACKGROUND OF THE INVENTION

This invention relates to anode structures, and more particularly, to impressed current sacrificial anodes for use in cathodic protection systems.

Use of sacrificial anodes for cathodic protection is a well established practice. Special anode designs have even been developed to compensate for the conditions which may be encountered in such systems. Thus in U.S. Pat. Nos. 3,043,765 and 3,239,443, both to Bryan et al and both assigned to the present assignee, there is disclosed high silicon iron anodes having unique connections which are protected from corrosive attack.

While these end structures are quite satisfactory for mild service conditions, in deep groundbed applications or in sea water service there is the need for a completely encapsulated moisture seal. An anode structure filling this need is disclosed in Sumner U.S. Pat. No. 3,471,395, assigned to the assignee of the present invention. There a heat shrinkable fluorocarbon resin sheath is used to form an encapsulated end seal.

Anodes of this design have proved excellent for moisture sealing, but may face additional problems in service. All anodes tend to discharge a high percentage of their total current from the extreme ends of the anode, resulting in a much higher corrosion rate at these locations. This high current density at the end is called current crowding or end effect and depending on the severity of service, metal consumption at this area can be great enough to cause anode separation in a short period of time, i.e., undercutting takes place at the end adjacent the end cap.

The insulating caps described in U.S. Pat. No. 3,471,395 protect the anode surface immediately under the cap, but this merely moves the "end" to the adjacent unprotected metal. Rapid corrosion at this point will then progress across the diameter of the anode and could even cut all the way through, allowing a large percentage of the anode weight to separate and fall away. Other end cap arrangements are shown in U.S. Pat. Nos. 3,046,213 to Bender and 2,816,069 to Andrus, but would for the aforesaid reasons suffer the same fate under the conditions described.

Localized rapid consumption of sacrifical anodes has been a problem in other areas too. For that reason, Anderson in U.S. Pat. No. 3,010,891 discloses a means of replacing the consumed portions of a trailing anode on ocean-going vessels. Thus, Anderson feeds a wire anode through a tube in such a manner that as the wire is consumed, it is replaced by a new length. Another anode structure with replaceable segments is shown in Krenzke, U.S. Pat. No. 3,016,343.

While replaceable segments is one solution, it is not always possible to effect such a replacement. For that reason, a more permanent installation is required for deep groundbed and sea water use. In that regard it is known to use steel pipes as anodes in deep groundbeds. The connection is welded to the pipe and is coated or extends out of the ground. The pipe is installed in sections with each section welded to the other for 200–300 feet depending on the hole depth. A coating strip running the full length of the pipe protects the pipe immediately beneath the strip thereby providing a path for current as the metal is being consumed during operation. This is a very costly setup. Besides, it does not eliminate the problems of current crowding and metal consumption at the point of the electrical connection.

Encapsulated rectifier anodes have also been used. In those structures the wire is welded to the inside of a pipe reducer. However, this would be impossible to do in a tubular anode. Likewise, anodes of this and other solid form suffer from another problem associated with deep groundbed or sea water service in that there is formation of a gas at the surface of the anode. This condition tends to occur because of the high current dissipation per square foot of anode surface. Gas bubbles insulate the surface and, therefore, inhibit the discharge of current.

Accordingly, there exists a need for an anode structure which will minimize the problem of gas blocking while at the same time offering longer service time with no current crowding and resultant undercutting.

SUMMARY OF THE INVENTION

The present invention utilizes an anode design which combines a long straight-wall hollow tubular body with an encapsulated cable-to-anode electrical connection located inwardly of the ends, and generally centrally located. The effect of this combination is to give an anode structure which has a uniform current discharge pattern which is effected only by the resistivity of the surrounding soil and/or electrolyte. There is a decrease in the tendency for gas blocking and the cable connection is protected from current crowding or end effect and other erratic consumption tendencies.

As described previously, in an ordinary anode there is an end effect which takes place due to the greater flow of positive ions breaking away from the two metal surfaces causing greater corrosion than in the middle where there is only one surface. Likewise, at an end capped anode there is a high current density area or current crowding which can lead to undercutting. In the anode of the present invention, while there is an end effect, this does not adversely affect the generally centrally located connection, That is, the anode is consumed from each end toward the middle. Consumption of the tubular inner surface is practically non-existent because of the longer electrolyte path to the outside of the anode.

Similarly, because there is more anode surface for an equivalent weight compared to a solid anode, the greater surface area allows a smaller current density in amperes/ft.$^2$. With the lower current density and greater surface area, a smaller volume of gas is produced per unit area reducing the tendency for gas blocking. The dissipation of the gas generated through the surrounding environment to vent pipes or through a porous path to the surface should be more easily accomplished. This makes the anodes of the present invention particularly suitable for use for deep ground-bed or sea water service, although, it may be used in any cathodic protection system.

Various means may be used to anchor the electrical conductor to the anode in a central location within the interior of the tubular body. For example, the contact means may be a cast plate of electrically conductive material which has a wire cable attached to it. An electrical potting compound is poured on each side of the contact means for moisture sealing and electrically non-conductive plastic resin caps are used to complete the encapsulation. An insulated cable is used and, for further protection of the insulated cable against wear, a guide means, disc or ring is provided at the cable end of the hollow tubular anode.

Accordingly, it is a primary object of the present invention to provide a tubular anode structure having an encapsulated centrally located internal connection.

Another object of the present invention is to provide a tubular anode structure having particular utility in deep groundbed and sea water cathodic protection systems.

Other objects and advantages of the invention will be apparent from the following description, the accompanying drawing and the appended claims.

DESCRIPTION OF THE PREFERRED EMBODIMENTS

Figure 1:
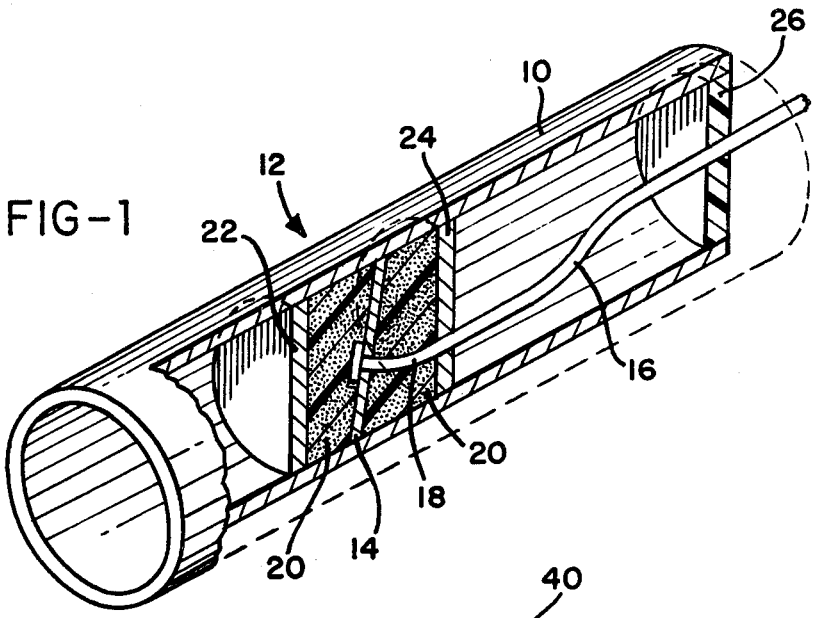
FIG. 1 shows the tubular anode of the present invention having a centrally located encapsulated cable-to-anode electrical connection.

Referring to FIG. 1, there is shown a hollow tubular anode body 10 of high silicon cast iron having in excess of about 10% silicon content, and preferably, a high silicon cast iron having approximately 12–15% silicon. Preferably the alloy also contains about 4.5% chromium. Representative commercially available materials are those available under the trademark DURIRON (high Si iron) and DURICHLOR (high SiCr iron) from The Duriron Company, Inc., Dayton, Ohio, assignee of the present invention. The anode body 10 may be of various lengths from 4 inches to 84 inches or even longer. In addition to being of varying lengths, the outside diameter and wall thickness may be varied. The diameters can be any standard pipe or tube dimensions, thus eliminating costly pattern or molding equipment. As an illustration, with a set length of 84 inches, tubular anodes of the following size characteristics may be used:

| WT. LB. | AREA SQ. IN. | AREA SQ.FT. | O.D. IN. | WALL THICK. IN. |
|---|---|---|---|---|
| 46 | 577 | 4.0 | 2-3/16 | 13/32 |
| 63 | 700 | 4.9 | 2-21/32 | 13/32 |
| 85 | 989 | 6.9 | 3-3/4 | 13/32 |
| 110 | 1253 | 8.7 | 4-3/4 | 13/32 |
| 220 | 1253 | 8.7 | 4-3/4 | 7.8 |

Interior of tubular anode body 10 is an encapsulated cable-to-anode electrical connection 12. Various forms of encapsulated connections may be used. In FIG. 1, a pre-cast contact plate 14 is formed of an electrically conductive fusible material such as lead, for example, a 14% tellurium antimonial lead cast plate. As illustrated, lead plate 14 is oversized so that when wedged and tamped into place by a centering device, an extremely secure connection is formed. Alternatively, other designs may be used to wedge the contact means into the anode to form a low resistance, strong connection. The resistance is less than 2 milliohms and, when used for such purposes as deep groundbed installations, the strength of the connections should be at least 1½ times that of the cable.

In the form shown, the electrical conductor is a wire cable 16, having a bared end 18 which is tinned. End 18 is soldered to the lead plate or wedge 14. Other materials such as babbit, solder or other low melting alloys may be used to form a firm, strong, mechanical and electrical connection between cable 16 and contact means 14. Similarly, the cable stands can be cast into the plate 14 when it is formed.

A plastic seal means is used to encapsulate the electrical connection and seal it from the electrolyte, moisture, and other deleterious materials. One part of the encapsulated unit is a mastic 20 on each side of plate 14 to protect the joint and to insulate the exposed end of the wire while chemically protecting it. A satisfactory material for the mastic 20 is Ozite B, a coal tar base electrical potting compound. Encapsulation is completed by utilizing caps 22 and 24 of an electrically non-conductive, chemically resistant plastic material such as epoxy resin. Suitable epoxy resins, i.e., an amine cured reaction product of epichlorohydrin and Bisphenol A, are those available under the trademark Durcon 164 and Durcon 2A from the assignee of the present invention. Other materials which may be used are chemically resistant polyesters and phenolics or modified phenolics.

The encapsulated seal means may be formed, for example, by placing a dam (i.e., a plastic disc) on one side of the contact means 14. Epoxy resin is then poured past contact means 14 so that it collects on the dam. It is then cured in situ to form cap 22. Mastic 20 is then poured on top of cap 22 and around contact means 14. Finally, cap 24 is formed by pouring epoxy resin on top of the mastic 20. This is cured in situ to complete the encapsulation.

As shown cable 16 passes through epoxy resin cap 24 in a sealing relationship so that the moisture barrier effectiveness of the encapsulation is not lost. At that point and beyond, cable 16 is sheathed with an electrically insulating material such as a high molecular weight polyethylene. Other materials may also be used such as polyvinylidene fluoride sold under the trademark KYNAR by Pennwalt Corp. of Philadelphia, Pa., or an ethylene-chlorotrifluoro-ethylene copolymer sold under the trademark HALAR by Allied Chemical Corp.

While the insulated coating on cable 16 would protect it somewhat from damage and shorting due to rubbing against the end of the tubular anode body through which it passes, it is desirable to have a guide means 26 to keep the cable from contacting the anode itself. In FIG. 1 the guide means 26 is a plastic disc such as polystyrene foam, rubber cork, epoxy, etc.

Figure 2:
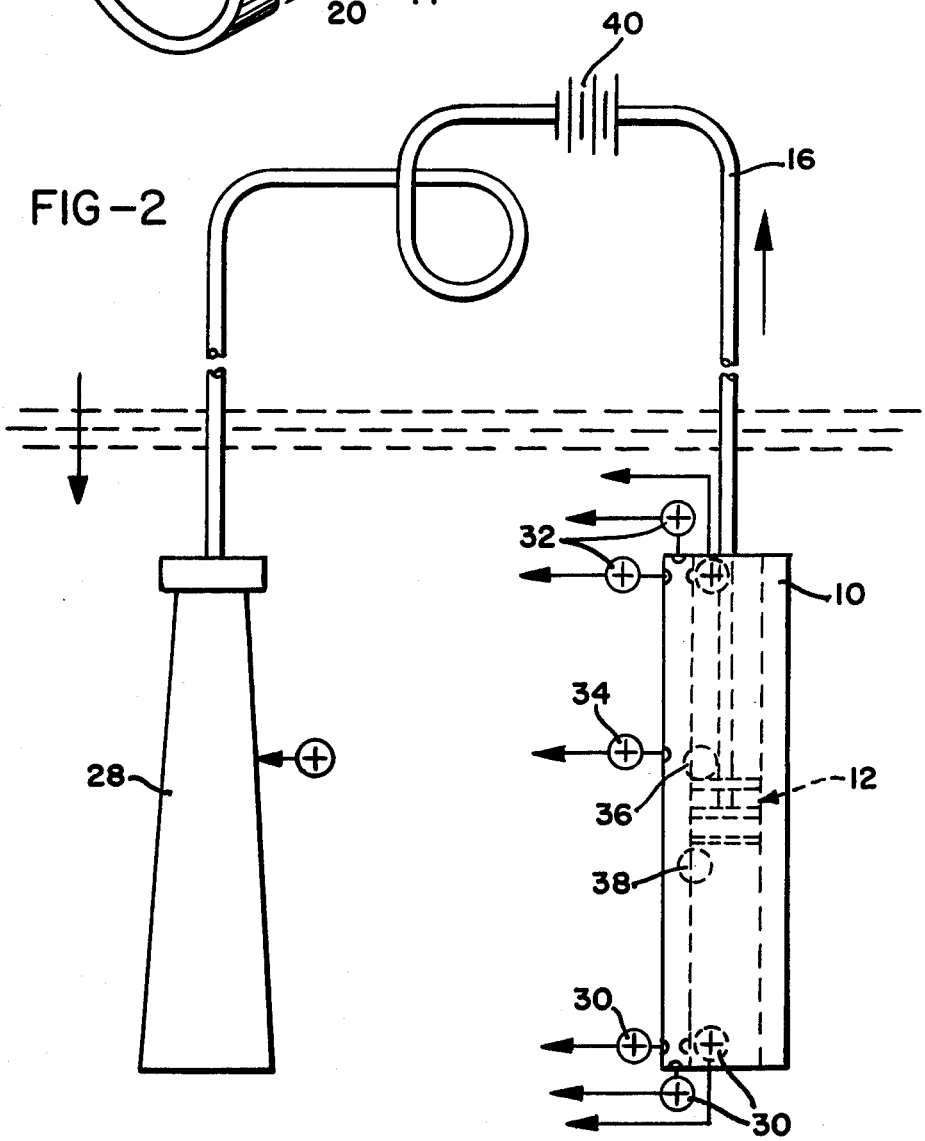
FIG. 2 illustrates the anode of FIG. 1 in operation.

In FIG. 2 an anode similar to the one shown in FIG. 1 is illustrated in a corrosion cell set-up. Tubular anode 10 having encapsulated center connections 12 is attached through metal conductor 16 to a cathode or non-corroding area 28. An external D.C. source 40 is used. Both electrodes are beneath the surface of an electrolyte or current carrying liquid which may be sea water or a deep groundbed. As illustrated, positive ions 30 and 32 are breaking away from the ends of the anode giving the end effect previously described. Likewise, positive ions 34 break away from the middle of the anode, but anode consumption here is at a slower rate because only one surface is present. At areas 36 and 38 in the interior of the anode, ions formed do not break away as easily because of the resistance of the electrolyte.

Field tests have shown that there is an even metal consumption pattern and that there is a reduced tendency for gas blocking. This latter result is due largely to the fact that the tubular anode offers a greater surface area for an equivalent weight compared to a solid anode. For example, a solid anode weighing 60 pounds (2

× 60 inches) would have a surface area of 2.8 square feet. A tubular anode of the present invention weighing 60 pounds (2.2 × 84 inches) has four square feet of surface area. The greater surface area allows a smaller current density in amperes/ft.$^2$. With the lower current density and large surface area, a smaller volume of gas is produced per unit area. As previously mentioned this is particularly important in cathodic protection systems such as deep groundbeds. In such systems, the anode structure of the present invention leaves the current free to discharge according to the resistivity of the surrounding soil and electrolyte.

While the article herein described constitutes a preferred embodiment of the invention, it is to be understood that the invention is not limited to this precise article, and that changes may be made therein without departing from the scope of the invention.

What is claimed is:

1. A tubular anode comprising a hollow straight-walled tubular anode body having solid walls of uniform thickness and having an open cylindrical interior, an electrical contact means located inwardly from the ends and within said interior of said tubular body, plastic seal means located on each side of said contact means, and an electrical conductor including an electrically insulating outer sheath, said conductor being connected to said electrical contact means and passing through one of said plastic seal means in a sealing relationship so that the seal means maintain an encapsulated anode-to-conductor electrical connection.

2. A tubular anode as in claim 1 further including a guide means at the end of said tubular body through which said electrical conductor passes.

3. A tubular anode as in claim 2 wherein said guide means is a disc.

4. A tubular anode as in claim 1 wherein said tubular body is of high silicon iron.

5. A tubular anode as in claim 1 wherein said plastic seal means is a combination of an electrical potting compound and epoxy resin caps.

6. A tubular anode as in claim 1 wherein said contact means is a cast lead material.

7. A tubular anode as in claim 6 wherein said tubular body is of high silicon chromium iron, said contact means is generally centrally located, said seal means is an electrical potting compound enclosed by epoxy resin caps, and further including guide means at one end of said tubular body, said electrical conductor passing through said guide means.

8. A tubular anode as in claim 1 wherein said contact means is wedged into said anode body to form a secure, low resistance connection.

* * * * *